US009099763B2

(12) United States Patent
Ferrari et al.

(10) Patent No.: US 9,099,763 B2
(45) Date of Patent: Aug. 4, 2015

(54) TUNABLE SLOW WAVE COPLANAR WAVEGUIDE TRANSMISSION LINE HAVING A MOVABLE SHIELDING PLANE

(75) Inventors: Philippe Ferrari, Sonnaz (FR); Gustavo Pamplona Rehder, Sao Paulo (BR); Philippe Benech, Grenoble Cedex (FR)

(73) Assignee: Universite Joseph Fourier (FR)

( * ) Notice: Subject to any disclaimer, the term of this patent is extended or adjusted under 35 U.S.C. 154(b) by 225 days.

(21) Appl. No.: 13/636,368

(22) PCT Filed: Mar. 22, 2011

(86) PCT No.: PCT/FR2011/050599

§ 371 (c)(1),
(2), (4) Date: Nov. 30, 2012

(87) PCT Pub. No.: WO2011/117532

PCT Pub. Date: Sep. 29, 2011

(65) Prior Publication Data

US 2013/0063229 A1 Mar. 14, 2013

(30) Foreign Application Priority Data

Mar. 23, 2010 (FR) ..... 10 52067

(51) Int. Cl.
*H01P 3/00* (2006.01)
*H01P 1/18* (2006.01)
*H01P 3/08* (2006.01)

(52) U.S. Cl.
CPC ..... *H01P 3/003* (2013.01); *H01P 1/184* (2013.01); *H01P 3/006* (2013.01); *H01P 3/081* (2013.01)

(58) Field of Classification Search
CPC ..... H01P 1/184; H01P 3/003; H01P 3/006; H01P 3/08; H01P 3/081
USPC ..... 333/161, 238
See application file for complete search history.

(56) References Cited

U.S. PATENT DOCUMENTS

| | | | | |
|---|---|---|---|---|
| 5,406,233 | A | 4/1995 | Shih et al. | |
| 5,504,466 | A * | 4/1996 | Chan-Son-Lint et al. | 333/159 |
| 6,950,590 | B2 * | 9/2005 | Cheung et al. | 385/129 |
| 2004/0155728 | A1 | 8/2004 | Cheung et al. | |
| 2008/0272857 | A1 | 11/2008 | Singh | |
| 2009/0315633 | A1 | 12/2009 | Ding et al. | |

FOREIGN PATENT DOCUMENTS

| | | | |
|---|---|---|---|
| EP | 1235296 | A1 | 8/2002 |
| JP | 2003264122 | A | 9/2003 |

(Continued)

OTHER PUBLICATIONS

Poplavko, Y., et al.: "Low Loss Microwave Piezo-Tunable Devices," Sep. 2006, 36th European Microwave Conference.
European Search Report for International Application No. PCT/FR2011/050599.

(Continued)

*Primary Examiner* — Benny Lee
(74) *Attorney, Agent, or Firm* — Kaplan Breyer Schwarz & Ottesen, LLP

(57) ABSTRACT

The invention relates to a high-frequency transmission line including a conductive tape (6) associated with a shielding surface (4) that is placed under the line structure and is divided into parallel microstrips in a direction generally orthogonal to the direction of the line, said microstrips being movable relative to the conductive tape.

7 Claims, 3 Drawing Sheets

(56) References Cited

FOREIGN PATENT DOCUMENTS

| | | | |
|---|---|---|---|
| JP | 2004512718 | A | 4/2004 |
| JP | 2011182311 | A | 9/2011 |

OTHER PUBLICATIONS

Translation of International Written Opinion of International Application No. PCT/FR2011/050599, filed: Mar. 22, 2011.

* cited by examiner

TUNABLE SLOW WAVE COPLANAR WAVEGUIDE TRANSMISSION LINE HAVING A MOVABLE SHIELDING PLANE

FIELD OF THE INVENTION

The present invention relates to a radio frequency (RF) transmission line. Radio frequency waves belong to the millimetric or submillimetric range, for example, to a frequency range from 10 to 500 GHz.

DISCUSSION OF PRIOR ART

The continual development of integrated circuits on silicon allows operations at very high frequencies in the radio frequency range. The passive elements used comprise adapters, attenuators, power dividers, and filters. Transmission lines connecting these elements form a basic element in an RF circuit. To make use of the silicon technology, transmission lines on chips with a high quality factor are required. Indeed, the quality factor is an essential parameter since it stands for the insertion loss of a transmission line for a given phase shift. Further, such lines must provide a determined phase shift and have a determined characteristic impedance for the frequency used.

Generally, the transmission lines are formed of a conductive tape having lateral dimensions ranging from 10 to 50 μm and a thickness on the order of one μm (from 0.5 to 3 μm according to the technology used). The conductive tape is surrounded with one or several lateral, upper or lower conductors forming ground planes intended to form a waveguide-type structure with the conductive tape. In technologies compatible with the forming of electronic integrated circuits, the conductive tape and the ground planes are formed of elements of metallization levels formed above a semiconductor substrate.

A type of transmission line with a particularly high performance is disclosed in U.S. Pat. No. 6,950,590, having its FIG. 4a copied in FIG. 1 hereof. On a silicon substrate 128 coated with metal levels separated by an insulator 127, is formed a lower ground plane 136 divided into parallel strips of small width, for example, ranging between 0.1 and 3 μm. In a higher metallization level is formed a central conductive tape 122 forming the actual transmission line, surrounded with lateral coplanar ground tapes 124, 126.

Features and advantages of such a line are described in detail in the above-mentioned patent. Central tape 122 and ground lines 124 and 126 being coplanar, this structure is currently called a coplanar waveguide, or CPW. Further, as indicated in this patent, the structure forms a slow wave coplanar waveguide, or S-CPW.

In a structure such as that in FIG. 1, the dimensions of the various elements are optimized to obtain, at a determined frequency, given phase characteristics as well as a given characteristic impedance. It is not possible to modify these characteristics once the line has been formed. For example, it is not possible to form a phase shifter having a given identical phase shift for several different frequencies, or an impedance matcher enabling to match various impedances.

SUMMARY

Thus, the present invention provides a transmission line of coplanar waveguide type which is particularly capable of being integrated on microelectronic integrated circuits wherein various parameters of the waveguide are adjustable to optimize the phase shift at a selected frequency and for a selected characteristic impedance, and to modify the line parameters to match with a different operating frequency or with a different characteristic impedance.

It is thus desired to form a transmission line where the characteristic impedance and the delay (that is, the phase difference between the signal at the line input and the signal at the line output) can be optimized independently.

An embodiment of the present invention provides a high-frequency transmission line comprising a conductive tape associated with at least one conductive plane, wherein at least one conductive plane is mobile with respect to the conductive tape.

According to an embodiment of the present invention, the transmission line is of slow wave coplanar waveguide type.

According to an embodiment of the present invention, at least one conductive plane is a shielding plane arranged under the line structure and divided into parallel microstrips having a general direction orthogonal to the line direction.

According to an embodiment of the present invention, the transmission line comprises electrostatic means for displacing the conductive plane.

According to an embodiment of the present invention, the transmission line comprises a second conductive plane under the shielding plane.

According to an embodiment of the present invention, the transmission line comprises means for selectively biasing the various microstrips.

According to an embodiment of the present invention, at least one conductive plane is formed of mobile coplanar ground tapes laterally surrounding the conductive tape.

According to an embodiment of the present invention, the transmission line comprises means for electrostatically shifting the ground tapes in a lateral direction.

According to an embodiment of the present invention, the transmission line comprises, on a semiconductor substrate, a first conductive plane, a second conductive plane or shielding plane divided into microstrips, a conductive tape surrounded with ground tapes, a cavity extending under a portion at least of the length of the tapes and of the shielding plane all the way to the vicinity of the first conductive plane.

BRIEF DESCRIPTION OF THE DRAWINGS

The foregoing and other objects, features and advantages of the present invention will be discussed in detail in the following non-limiting description of specific embodiments in connection with the accompanying drawings, among which.

It should be noted that generally, as usual in the representation of microelectronic components, the elements of the various drawings are not to scale.

DETAILED DESCRIPTION

Figure 1:
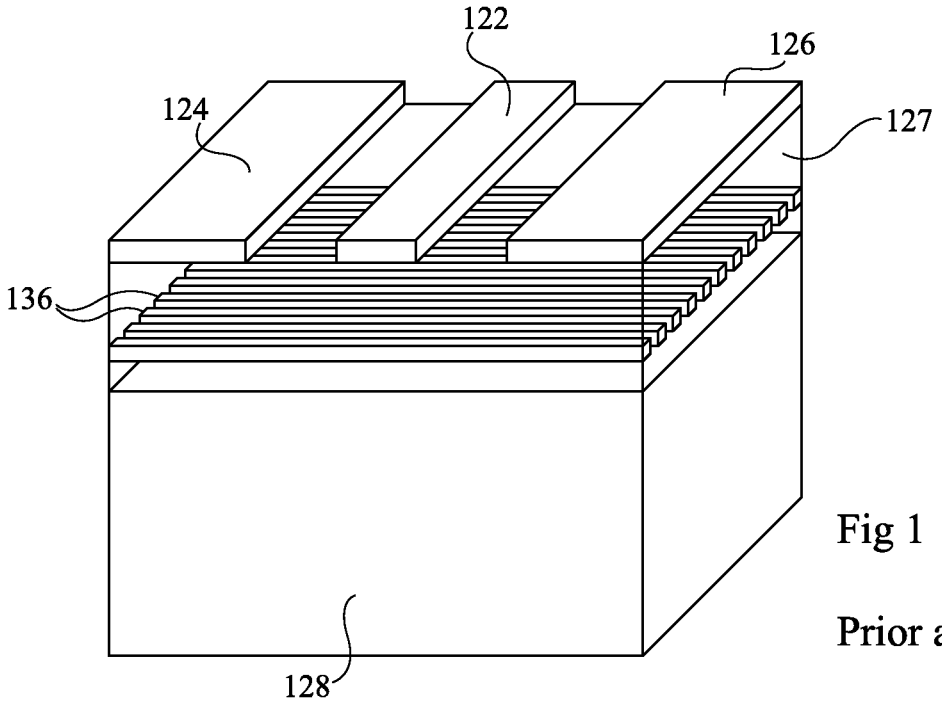
Fig 1 Prior art
FIG. 1 is a copy of FIG. 4a of U.S. Pat. No. 6,950,590.
Figure 2A:
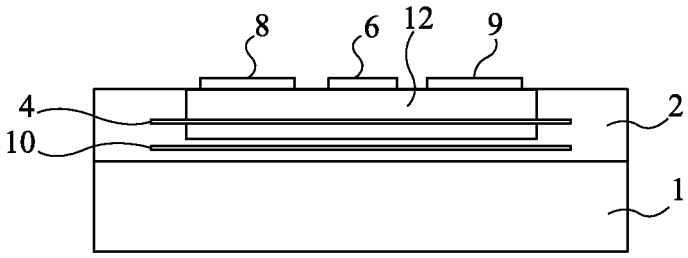
FIGS. 2A, 2B, and 2C are cross-section views of a transmission line according to an embodiment of the present invention, in three positions.
Figure 2B:
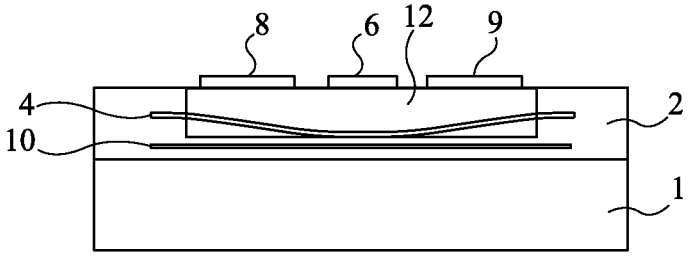
Figure 2C:
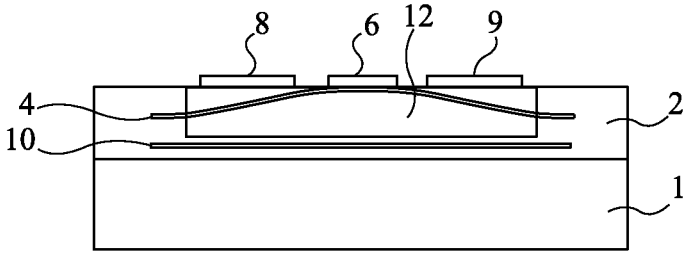

FIGS. 2A-2C are cross-section views of an S-CPW type transmission line. A perspective view of this structure would be similar to that illustrated in FIG. 1.

Figure 3A:
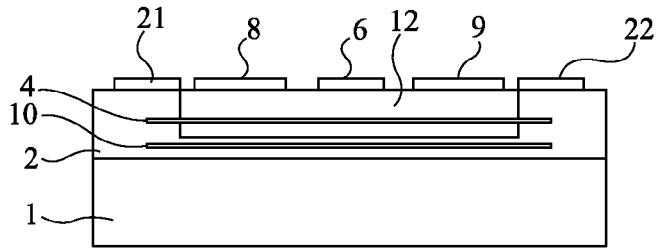
FIGS. 3A, 3B, and 3C respectively are a cross-section view, a perspective view, and a top view of a transmission line according to an embodiment of the present invention.
Figure 3B:
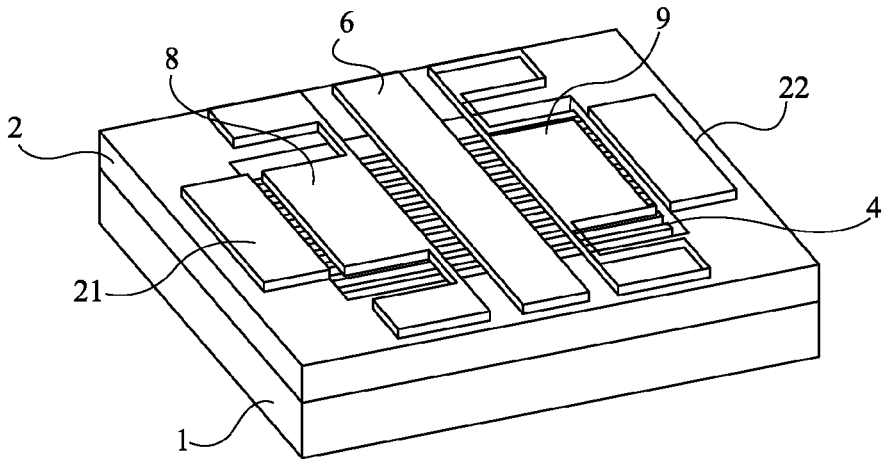
Figure 4:
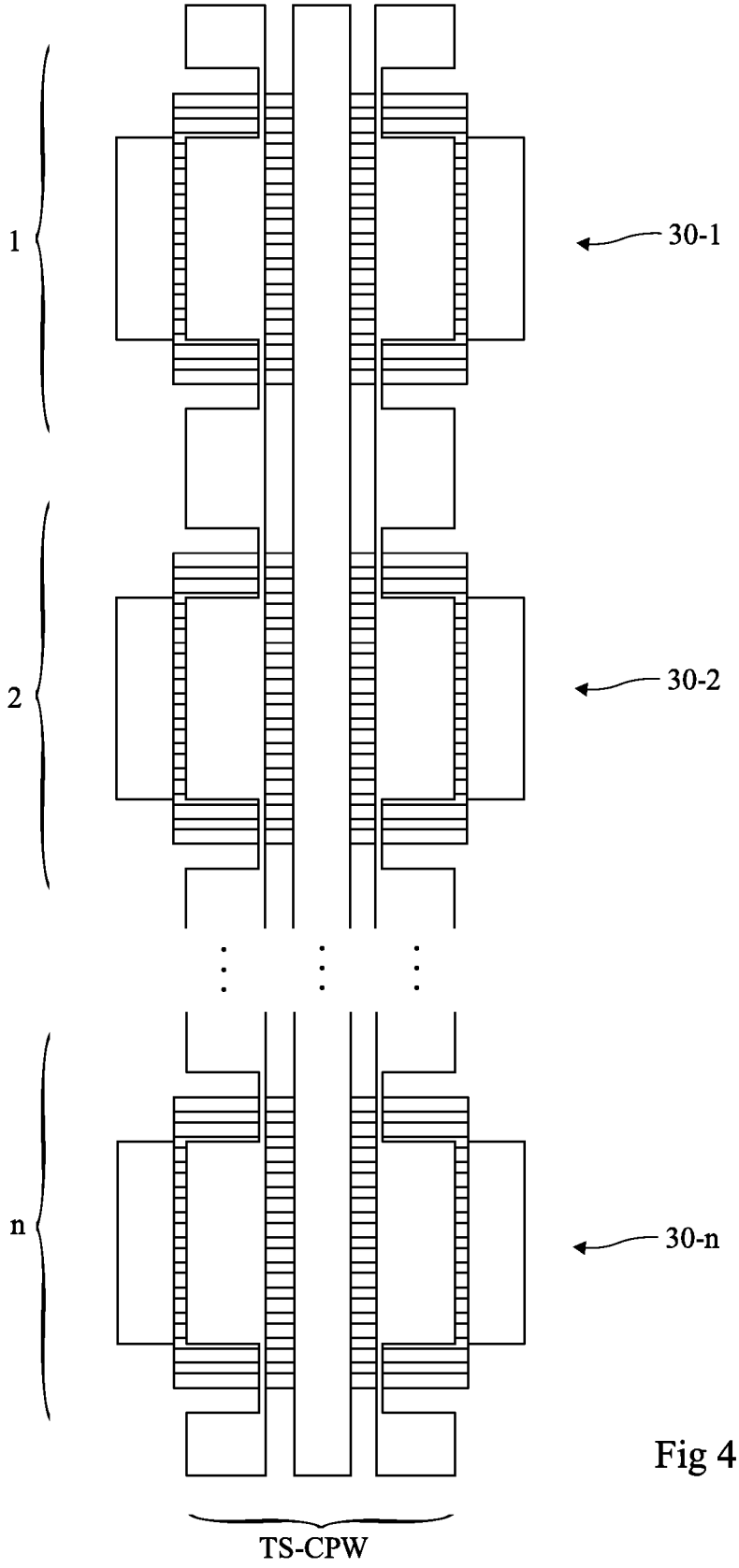
FIG. 4 is a top view of another embodiment of the tunable slow wave coplanar waveguide (TS-CPW) of the present invention.

Referring to FIGS. 2A, 2B, and 2C, on a substrate 1 (also shown in FIGS. 3A, 3B and 4), for example, a semiconductor substrate, for example, made of silicon, are formed metallization levels separated by an insulating material 2 (also shown in FIGS. 3A, 3B, and 4). In an intermediary metallization level is formed a shielding plane divided in microstrips 4 similar to structure 136 of FIG. 1. Above this metallization level is formed a central transmission tape 6 similar to tape 122 of FIG. 1 and, on either side of this central tape are formed lateral ground tapes 8 and 9 similar to ground tapes 124 and 126 of FIG. 1.

Further, in the shown embodiment of FIGS. 2A, 2B, and 2C, a metallization plane 10 is provided at a lower level. Plane 10 may be divided into microstrips parallel to those of shielding plane 4.

As shown in FIGS. 2A 2B, and 2C, a cavity 12 is provided which defines a vacuum space under central tape 6 and on either side thereof. In the shown example, cavity 12 extends in the insulating material across the width of the central tape and of the lateral tapes, stopping a little above metallization level 10. Thus, the microstrips of shielding plane 4 are laterally anchored in insulating material 2 and their central portion is free. If a D.C. potential difference is applied between metallization planes 4 and 10, the metal microstrips of shielding plane 4 will be attracted downwards by metallization 10, as shown in FIG. 2B. Conversely, if a potential difference is applied between line 6 and the microstrips of shielding plane 4, the microstrips will be attracted upwards by line 6, as shown in FIG. 2C. It should be noted that an insulator, not shown, is formed under tape 6 and/or on the microstrips to avoid shorting these elements.

Although this is not shown in the cross-section view of FIG. 2A, it should be clear that a portion only of the line length is located above cavity 12 and that each of the tapes of the line (the central tape and the lateral ground tapes) bears against insulating portions located at the back and at the front of the cross-section plane.

Decreasing or increasing the distance between strip 6 and the elements of shielding plane 4 will have as a main effect to modify equivalent capacitance $C_{eq}$ of the transmission line. This causes a modification of characteristic impedance $Z=(L_{eq}/C_{eq})^{1/2}$ of the line, $L_{eq}$ being the equivalent inductance of the line. Correlatively, the phase velocity of the propagation signal, $v_\Phi=1/(L_{eq}\cdot C_{eq})^{1/2}$, will be modified, which results in a modification of the electric length of the line, $\theta=l(\omega/v_\Phi)$, where l stands for the physical length of the transmission line and $\omega$ for the angular frequency of the signal.

$C_{eq}$ could be modified by applying variable potential differences between ground plane 4 and lower metallization plane 10 or the transmission line. However, it will be preferred, in practice, to act in all or nothing by applying potentials such that, in the idle state, the microstrips of shielding plane 4 are substantially horizontal (FIG. 2A), in a second state, these strips are in a low end position (FIG. 2B) and, in a third state, the strips are in a high end state (FIG. 2C).

To finely adjust the capacitance variation, it may be provided to selectively move a selected number of strips of shielding plane 4 by applying the potential capable of generating an electrostatic attraction force with the lower conductive plane or with the conductive tape by selectively biasing a selected number of these conductive tapes.

As seen previously, the ability to selectively modify equivalent capacitance $C_{eq}$ results in an ability to modify the characteristic line impedance and the phase velocity of a signal in the line. This however does not enable to independently set the two parameters. To enable to independently set the characteristic impedance and the phase velocity, an embodiment of the present invention provides for the lateral distance between the lateral ground tapes and the central tape to be settable, which essentially results in modifying equivalent inductance $L_{eq}$ of the line.

Figure 3C:
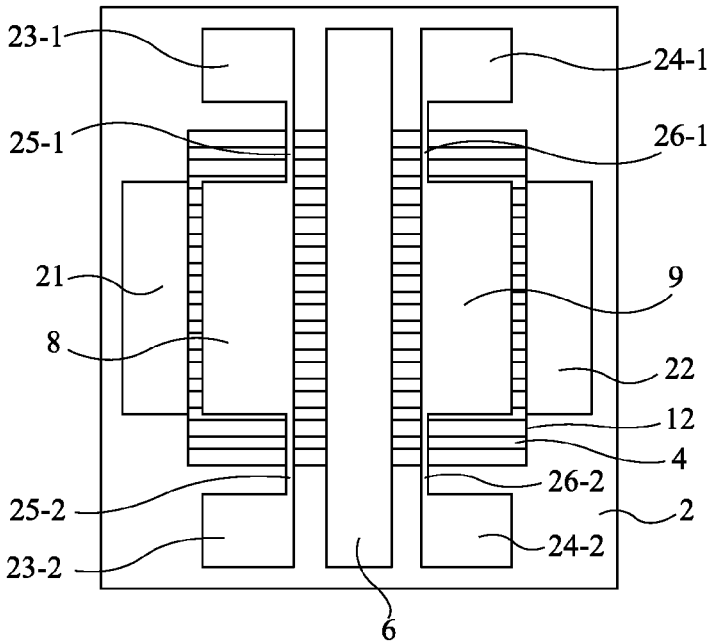

A first embodiment of a structure enabling to obtain this independent setting is illustrated in FIGS. 3A, 3B, 3C which respectively are a cross-section view, a perspective view, and a top view. FIGS. 3A, 3B, and 3C will be collectively described hereinafter.

The structure of FIGS. 3A, 3B, and 3C is similar to that of FIG. 2A. It comprises lower conductive plane 10 (FIG. 3A), intermediary plane 4, and central tape line 6 surrounded with ground tapes 8 and 9. While in the case of the structure of FIGS. 2A, 2B and 2C, ground tapes 8 and 9 were not necessarily totally comprised above cavity 12 (FIGS. 3A and 3C), they are now, to be able to be laterally mobile under the effect of a voltage difference between these ground tapes and external lateral electrodes 21, 22. Ground tapes 8 and 9 are connected to pads 23-1, 23-2, and 24-1, 24-2 respectively formed on insulator 2 by blades 25-1, 25-2, and 26-1, 26-2, as shown in FIG. 3C. Blades 25-1, 25-2, and 26-1, 26-2 form a spring and enable a displacement of ground tapes 8 and 9 when they are attracted by external electrodes 21, 22. Of course, an electrostatic attraction between the central conductor and ground planes 8 and 9 may also be provided.

Stop systems may be provided to limit the displacement of ground planes and avoid a short-circuit between these ground planes and electrodes 21, 22 or central conductor 6. Such stops may for example be formed on insulating layers deposited on the lateral surfaces of the various elements.

This relative displacement of the lateral ground tapes with respect to the central tape mainly results in modifying equivalent inductance $L_{eq}$ of the transmission line. $L_{eq}$ and $C_{eq}$, and thus Z and $v_\Phi$, can thus be set independently.

FIG. 4 is a top view illustrating an alternative embodiment of the present invention. The transmission line is divided into a succession 30-1, 30-2 . . . **30-*n* of n line elements, each of which has the structure illustrated in FIGS. 3A, 3B, 3**C. It should be understood that this multiplies setting possibilities.

The present invention is likely to have various alterations, modifications, and improvements which will readily occur to those skilled in the art. Various means may be used to displace the shielding plane, the central tape, and the lateral ground tapes with respect to one another.

The present invention has been described in the context of a specific example of its application to an S-CPW type structure. It should however be understood that it generally applies to other types of tape transmission lines having parameters depending on the distance(s) between this tape and various ground planes.

As indicated previously, for the displacement of shielding plane 4, it may be provided for this displacement to be only possible upwards, or only downwards. It may also be provided for this displacement to be selective, that is, for the different microstrips of the structure forming shielding plane 4 to be able to be displaced individually. In the detailed embodiment, the microstrips are embedded at their two ends. It may also be provided for these microstrips to be interrupted in their middle portion and to be embedded at a single one of their ends (under central tape 6 or under ground tapes 8, 9) to form embedded beams. In this case, it may be provided that at least a central portion of the central tape or of the ground tapes is laid on an insulator to embed the beams which form shielding plane 4.

Various alternative embodiments may also be used as concerns lateral displacements. In particular, attraction electrodes 21 and 22 and ground tapes 8, 9 may be coupled by interdigited structures, as shown in FIGS. 3B and 3C. Further, the blades forming springs 25-1, 25-2, 26-1, 26-2 (FIG. 3C) may have various configurations, for example, meander shapes.

One of the advantages of the structure described herein is that it is compatible with current techniques for forming metallization levels generally used to form interconnects above a microelectronic integrated circuit.

As an example only, the following dimensions may be selected for a transmission line intended to operate at frequencies close to 60 GHz:

- tape width and distance between tapes 6, 8, 9: ranging between 7 and 15 μm;
- vertical distance between metallization levels: ranging between 0.5 and 2 μm;
- distance between ground tapes 8 and 9 and electrodes 21 and 22: ranging between 0.5 and 2 μm.

Such values enable to control the electrostatic displacement of the various elements with voltages having values on the order of some ten volts and to cause variations of the capacitance and inductance values by a factor ranging between 1.5 and 3.

The invention claimed is:

1. A high-frequency transmission line of slow wave coplanar waveguide type comprising, in an insulating material covering a substrate, a conductive tape defining a line structure and associated with a shielding plane arranged under the line structure and the shielding plane divided into parallel microstrips having a general direction orthogonal to a line direction of the line structure, wherein a cavity extends in the insulating material under a portion at least of a width of the conductive tape and of the shielding plane, and wherein the shielding plane is movable with respect to the conductive tape.

2. The transmission line of claim 1, wherein the shielding plane is displaceable in response to an electrostatic attraction force.

3. The transmission line of claim 1, further comprising a second conductive plane under the shielding plane.

4. The transmission line of claim 1, further comprising means for selectively biasing the parallel microstrips.

5. The transmission line of claim 1, further comprising laterally mobile coplanar ground tapes surrounding the conductive tape.

6. The transmission line of claim 5, wherein the ground tapes are displaceable in a lateral direction in response to an electrostatic attraction force.

7. The transmission line of claim 6, further comprising external electrodes for applying the electrostatic attraction force to the ground tapes.

* * * * *